US008749884B2

(12) United States Patent
Jahromi

(10) Patent No.: US 8,749,884 B2
(45) Date of Patent: Jun. 10, 2014

(54) TELESCOPIC GUN SIGHT FREE OF PARALLAX ERROR

(76) Inventor: Omid Jahromi, Playa Vista, CA (US)

( * ) Notice: Subject to any disclaimer, the term of this patent is extended or adjusted under 35 U.S.C. 154(b) by 458 days.

(21) Appl. No.: 12/773,833

(22) Filed: May 4, 2010

(65) Prior Publication Data

US 2011/0271576 A1 Nov. 10, 2011

(51) Int. Cl.
*G02B 23/00* (2006.01)

(52) U.S. Cl.
USPC ..... 359/428; 42/122; 42/132

(58) Field of Classification Search
USPC ..... 42/119, 120, 122; 359/399, 407, 421, 359/429
See application file for complete search history.

(56) References Cited

U.S. PATENT DOCUMENTS

| | | | | |
|---|---|---|---|---|
| 2,858,732 | A | 11/1958 | Kollmorgen et. al. | |
| 3,336,831 | A | 8/1967 | Unertl, Jr. | |
| 3,608,997 | A * | 9/1971 | Humphrey | 359/557 |
| 3,712,702 | A * | 1/1973 | Schmidt | 313/524 |
| 4,072,396 | A | 2/1978 | Ross et al. | |
| 4,417,814 | A * | 11/1983 | Doliber | 356/252 |
| 4,792,673 | A * | 12/1988 | Blackler | 250/214 VT |
| 5,497,266 | A * | 3/1996 | Owen | 359/353 |
| 5,668,674 | A * | 9/1997 | Kanai et al. | 359/835 |
| 5,754,274 | A * | 5/1998 | Nordquist | 351/223 |
| 5,802,406 | A * | 9/1998 | Otaki et al. | 396/150 |
| 5,893,650 | A * | 4/1999 | Ohmura | 396/51 |
| 6,865,022 | B2 | 3/2005 | Skinner et al. | |
| 6,975,358 | B1 * | 12/2005 | Morley | 348/335 |
| 7,944,611 | B1 * | 5/2011 | Regan et al. | 359/422 |
| 2001/0050817 | A1 * | 12/2001 | Travers et al. | 359/630 |
| 2003/0147049 | A1 * | 8/2003 | Jacumet | 352/171 |
| 2006/0201047 | A1 * | 9/2006 | Lowrey | 42/122 |
| 2009/0199702 | A1 * | 8/2009 | Zaderey et al. | 89/41.17 |

* cited by examiner

*Primary Examiner* — Arnel C Lavarias

(57) ABSTRACT

A telescopic gun sight free of parallax error is introduced which can accurately display a weapon's point of aim independent of the position of the shooter's eye. Additionally, the telescopic gun sight provides a wide viewing angle and a long, comfortable eye-relief.

6 Claims, 5 Drawing Sheets

TELESCOPIC GUN SIGHT FREE OF PARALLAX ERROR

I. CROSS-REFERENCE TO RELATED APPLICATIONS

Not Applicable

II. FEDERALLY SPONSORED RESEARCH

Not Applicable

III. SEQUENCE LISTING OR PROGRAM

Not Applicable

IV. FIELD OF THE INVENTION

This application relates to optical sights, specifically to a new means of eliminating parallax error in telescopic gun sights.

V. BACKGROUND OF THE INVENTION

A gun sight is a device used to provide an accurate point of aim for firearms such as rifles, handguns and shotguns. Sights are used on other types of weapons such as bows and crossbows as well. Popular gun sights include the traditional metallic sights (also known as "iron sights") and telescopic sights (also called "rifle scope" or "scope" for short). Other types of sights include red-dot sights, holographic sights, laser sights, etc.

Traditional metallic sights are inexpensive, sturdy and light in weight. However, the shooter is required to line up the rear sight with the front sight and the target. With a telescopic sight, he simply lines up the sight's cross hairs (reticle) with the target. It is very difficult for the human eye, if not impossible, to try to switch its focus from a rear sight to a front sight to a target as required with metallic sights, and its frustrating to say the least. Telescopic sights eliminate this frustration. Furthermore, most telescopic sights also magnify, making the target appear closer, and therefore easier to see, enabling the shooter to place a more precise shot on the target.

A telescopic sight can dramatically improve the functionality of a firearm by providing the shooter with a simple yet highly accurate means for aiming at distant targets. Current designs, however, do not completely eliminate the requirement that the shooter must align his eye with the sight.

A first disadvantage of current telescopic sights is that if the shooter's eye is not aligned with the optical axis of the sight, he will not see the complete field of view. This problem becomes more prominent in high-magnification scopes where even a slight misalignment of the eye from the optical axis can cause the target image to partially or completely black out. In high stress situations, this makes fast target acquisition very difficult.

A second, more severe, disadvantage of telescopic sights is that the shooter might also misplace the shot due to a phenomenon called parallax error. Telescopic sights use an objective lens to form an image of the target on the reticle. The exact location of this image depends on the target distance. Therefore, for long and short shots, the target image is focused either in front of or behind the reticle. If the image is not coplanar with the reticle, then putting one's eye at different points behind the sight's ocular (eyepiece lens) causes the reticle to appear to be at different points on the target (see FIGS. 1*a* and 1*b*). This phenomenon is referred to as parallax error.

Parallax error is a serious issue as it prevents a shooter from aiming accurately if he happens to be looking at an angle into the sight. Most manufacturers design their telescopic sights to be free of parallax error at a fixed distance, say 100 yards. However, if the target is at any distance greater than or less than 100 yards, which is often the case, there is potential for misplacing the shot as the parallax error may cause the shooter to aim at an offset distance from the intended target point.

A telescopic sight which uses an adjustable objective (AO) to compensate for parallax error has been disclosed in U.S. Pat. No. 2,858,732 issued Nov. 4, 1958 to E. O. Kollmorgen, et. al. By adjusting the objective, one can focus the image of targets located at various distances exactly on the plane of the reticle and eliminate parallax error. Other prior art on scopes with adjustable objective include U.S. Pat. No. 3,336, 831 issued Aug. 22, 1967 to J. Unertl, Jr. and U.S. Pat. No. 4,072, 396 issued Feb. 7, 1978 to C. J. Ross and W. R. Weaver. Currently, several manufacturers (e.g., Schmidt and Bender GmbH of Biebertal, Germany) make scopes with adjustable objectives where they are also designated as Parallax Adjustable (PA), Side Focusing (SF), etc.

A major drawback with AO scopes is that to adjust the objective for parallax-free aiming, the shooter must either know the exact distance to the target or use a process of trial and error. That is, he must position his scoped firearm on a steady platform so that it is aiming at the target without any movement. Then, without touching the gun or the scope, move his head from side to side while looking through the scope. If the reticle moves around on the target, the shooter is seeing parallax error. He then needs to adjust the objective and repeat this experiment until he observes no reticle movement when he moves his head behind the scope. Clearly, this is a time consuming and often impractical task to do in the field.

Another approach to deal with parallax error has been contemplated in U.S. Pat. No. 6,865,022 issued Mar. 8, 2005 to S. J. Skinner and S. D. Moore. This patent teaches an improved reticle that can give the shooter visual indication when his eye is not properly aligned with the optical axis of the scope. This may help detect parallax error but it doesn't actually eliminate it. The shooter is still required to perfectly align his eye with respect to the optical axis of the sight. Therefore, this design is not a solution to the problem.

VI. SUMMARY OF THE INVENTION

The present invention teaches a parallax-free telescopic sight with a wide viewing angle. It overcomes all the limitations of the prior art by eliminating parallax error at all distances with no need for user adjustments. Furthermore, the present invention achieves these improvements simply and inexpensively with an easily implemented coherent image conduit.

In accordance with one embodiment, this invention introduces a telescopic gun sight comprising an objective lens, an image erecting means, and a fiber optic faceplate, whose apparent point of aim is insensitive to both the lateral and longitudinal location of the shooter's eye, thereby providing a wide, comfortable viewing angle and eliminating parallax error.

VII. BRIEF DESCRIPTION OF THE DRAWINGS

The foregoing aspects and many of the attendant advantages of this invention will become more readily apparent with reference to the following detailed description of the invention, when taken in conjunction with the appended claims and accompanying drawings, wherein:

FIGS. 1*a* and 1*b* illustrate the phenomenon of parallax error in a telescopic gun sight.

VIII. DETAILED DESCRIPTION OF THE INVENTION

Details of the arrangement of elements characterizing the invention will be more fully understood from the description of preferred embodiments with reference to the accompanying drawings. A novel element of the present invention is the placement of a coherent image conduit in the optical path of a telescopic gun sight.

A coherent image conduit is an image relay device which has an incident surface and an emitting surface. It can transfer an image coherently from its incident surface to its emitting surface point by point (pixel by pixel) such that the brightness of each image point (pixel) on the emitting surface depends only on the light rays arriving at the corresponding image point (pixel) on the incident surface.

Image transfer by a coherent image conduit is fundamentally different from light transfer by an ordinary glass window. In an ordinary glass window, light rays arriving at different points on the rear surface of the window can pass through the window in an oblique direction and emerge from the same point on the front surface. However, one can not generally see through a coherent image conduit. An observer looking at an image transferred by a coherent image conduit will see the same substantial image if he changes the position of his eye. When looking from an angle at an image transferred by a coherent image conduit, image brightness or contrast may degrade but the image itself does not change. This is similar to watching a garden scene on TV versus watching a real garden through a house window: The scene displayed on TV does not change if a viewer changes his position in the room but the scene of a real garden watched through an ordinary house window does change if one walks across the room.

A coherent image conduit can be made using optical fiber bundles, micro lens arrays, capillary arrays, rod lens arrays (also known as Gradient Index (GRIN) or Self Focusing (SELFOC) lens arrays), and a variety of other devices known to the persons skilled in the art of optical engineering. For the purpose of the present invention certain types of focusing screens (such as those made of ground glass are considered coherent image conduits as well. In this invention, a coherent image conduit comprised of a fiber optic faceplate is preferred. However, this shall not be construed as limiting the invention to this particular type of coherent image conduit. Other types of coherent image conduit such as those mentioned above can also be used.

Figure 1A:
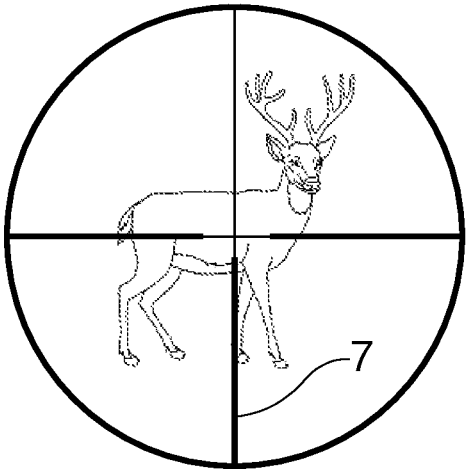
Figure 1B:
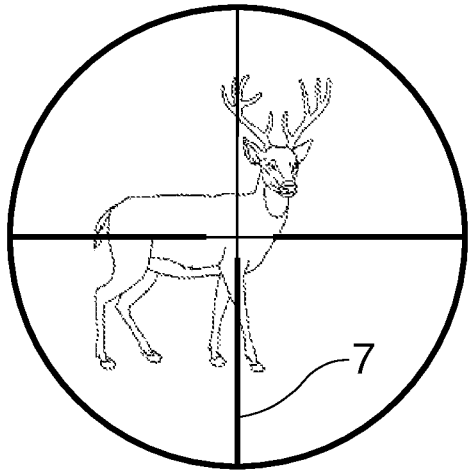
Figure 2:
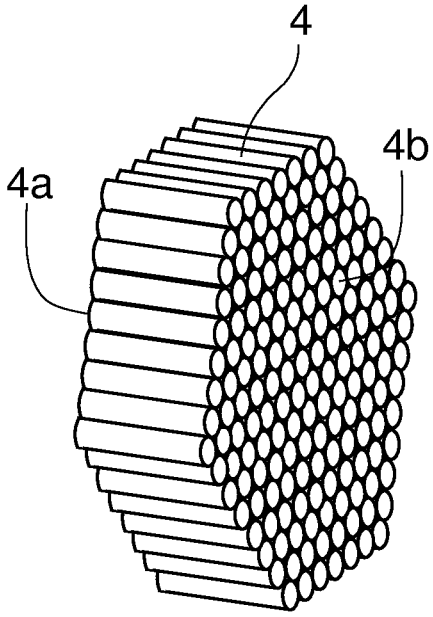
FIG. 2 is a perspective view illustrating the structure of a fiber optic faceplate.

FIG. 2 shows a perspective schematic view of the structure of a fiber optic faceplate (FOFP). With reference to this figure, a fiber optic faceplate 4 consists of a group of relatively short, aligned optical fibers fused together in an optical window or block. This block has a rear, incident surface 4*a* and a front, emitting surface 4*b*. The fiber optic faceplate 4 is a coherent image conduit in the sense that it can transfer an image pixel by pixel (fiber by fiber) from its incident (rear) surface 4*a* to its emitting (front) surface 4*b* with minimal distortion or loss of light.

The principle of channeling light within a long narrow optical fiber (fiberoptics) can be found in several textbooks including *Optics, 3rd Ed.* by Eugene Hecht, Addison-Wesley, Reading, Mass., 1998, ISBN 0-201-83887-7. Several applications of fiber optic faceplates are described in *Applied Photographic Optics, 3rd Ed.* by Sidney F. Ray, Focal Press, Oxford, UK, 2002, ISBN 0-24051540-4, and in *Modern Optical Engineering, 4th Ed.* by Warren J. Smith, McGraw-Hill, New York, NY, 2008, ISBN 978-0-07-147687-4.

Fiber optic faceplates are used in advanced image transfer applications including charge-coupled devices (CCDs), Cathode Ray Tubes (CRTs), Liquid Crystal Displays (LCDs), image intensification devices, and X-ray imaging systems. Manufacturers such as Schott AG of Mainz, Germany, and Hamamatsu Photonics of Hamamatsu City, Japan, make high-resolution FOFPs with fiber diameters as low as 3 microns. Such FOFPs can transfer images with resolution better than 160 lines per millimeter.

A. First Embodiment of the Invention

Figure 3:
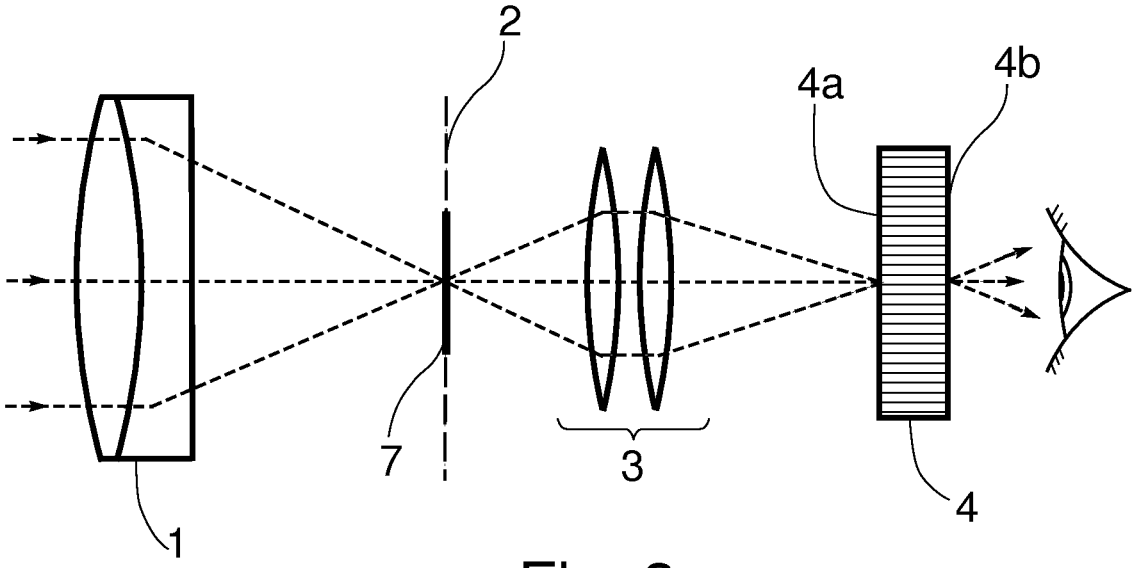
FIG. 3 is a side view depicting the arrangement of elements in a first embodiment of the invention.

FIG. 3 shows a side schematic view of a telescopic gun sight in accordance with a first embodiment of the invention. With reference to FIG. 3, the first embodiment of the invention has an objective 1 which is an image forming device. The objective 1 has a focal plane 2 and an optical axis (not shown). The optical axis of the objective forms the optical axis of the telescopic gun sight. An image erecting means 3 is positioned on the optical axis after the objective. A fiber optic faceplate 4 is placed on the optical axis after the image erecting means 3. A reticle 7 is placed on the optical axis coplanar with the objective focal plane 2 to designate the point of aim. The entire assembly may be encased in a suitable housing. The housing is not an essential feature of the invention and is not shown.

When said telescopic gun sight is pointed at a distant target, the objective 1 forms a first image of the target at the objective focal plane 2. This first image is laterally reversed and upside-down. The image erecting means 3 converts said first image of the target into an upright and laterally correct second image of the target. This second image is formed on the incident surface 4*a* of the fiber optic faceplate 4. The fiber optic faceplate 4 transfers said second image, pixel by pixel, forming a third image on its emitting surface 4*b*. Since the reticle 7 is also coplanar with the incident surface 4*a* of the fiber optic faceplate 4,an image of the reticle will be seen superposed on said third image formed on the emitting surface 4*b* of the the fiber optic faceplate 4.

To use the telescopic sight described above, a shooter (or operator) places his eye at the rear end of the sight behind the emitting surface 4*b* of the fiber optic faceplate 4. He then sees said third image of the target with an image of the reticle 7 superposed. This enables him to determine his point of aim on the target.

When the shooter points the telescopic gun sight shown in FIG. 3 at targets located at various distances, the precise position of said first image of the target on the optical axis will vary depending on target distance. This image will be formed close to the objective focal plane 2 but not necessarily coplanar with it. Therefore, in general, the reticle 7 which is positioned coplanar with the objective focal plane 2 will not be coplanar with the first target image formed by the objective 1. However, the presence of the fiber optic faceplate 4 in the optical path of the telescopic sight prevents the shooter from looking at the reticle 7 from an oblique direction. This, in turn, prevents the shooter from seeing any parallax between the reticle 7 and said first image of the target even if they are not coplanar. Thus, parallax error is completely eliminated.

This embodiment of the invention has yet another advantage compared to the prior art: It does not have a pre-determined eye relief. In traditional telescopic sights, the shooter must place his eye at a pre-determined distance behind the eyepiece lens (ocular) in order to see the complete field of view. This distance is known as eye relief and is usually set to about 4 inches for telescopic sights designed for use on hunting rifles. However, in this embodiment of the invention the shooter can put his eye at any distance behind the FOFP and still see the complete field of view. This makes this embodiment of the invention very desirable as a telescopic sight for weapons such as handguns and archery bows where the weapon is held at arms length during aiming.

Human eye accommodation is such that one is not comfortable focusing on images closer than about 25 centimeters. Therefore, viewing the target could become uncomfortable or visual acuity may be lost if the shooter places his eye less than 25 centimeters away from the rear end of the telescopic sight described in this embodiment. A variation that allows the shooter to place his eye closer to the rear end of the sight is described in the next embodiment of the invention.

B. Second Embodiment of the Invention

Figure 4:
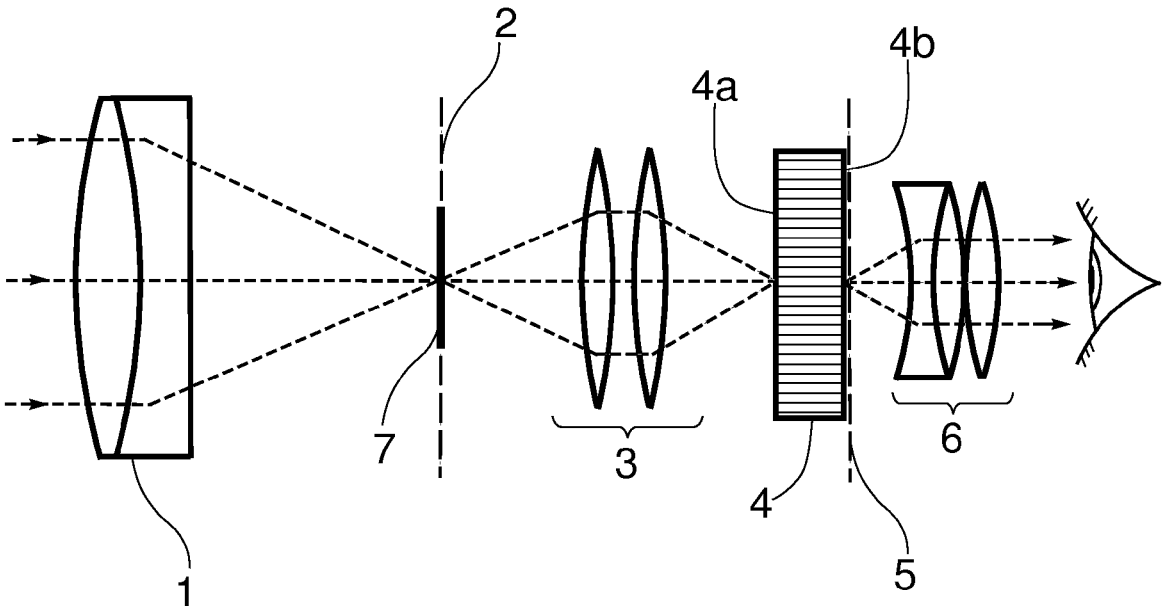
FIG. 4 is a side view depicting the arrangement of elements in a second embodiment of the invention.

FIG. 4 shows a side schematic view of a second embodiment of the invention. In this embodiment an eyepiece 6 is added to the assembly described in the first embodiment. The eyepiece 6 is positioned on the sight's optical axis, after the fiber optic faceplate 4, and at the rear end of the sight. The eyepiece 6 is positioned such that it converts the target image displayed on the emitting surface 4*b* of the fiber optic faceplate 4 into a virtual (and possibly magnified) image for the shooter's eye to see. The eyepiece 6 may comprise one or more lenses or lens groups. Persons skilled in the art of optical engineering are familiar with the principles of designing an eyepiece. A plurality of suitable eyepiece designs can be found in *Handbook of Optical Systems, Vol.* 4: *Survey of Optical Instruments* edited by Herbert Gross, Wiley-VCH Verlag GMBH & Co., Weinheim, Germany, 2008, ISBN 978-3-527-40380-6.

The added eyepiece 6 allows the shooter to place his eye closer to the rear end of the sight as compared to the first embodiment. It can also provide additional image brightness thanks to the eyepiece 6 gathering divergent light rays emitted from each pixel on the emitting surface 4*b* of the fiber optic faceplate and converging them into the pupil of the shooters's eye. In addition, the eyepiece 6 can be designed to provide variable magnification (zoom) features.

C. Third Embodiment of the Invention

Figure 5:
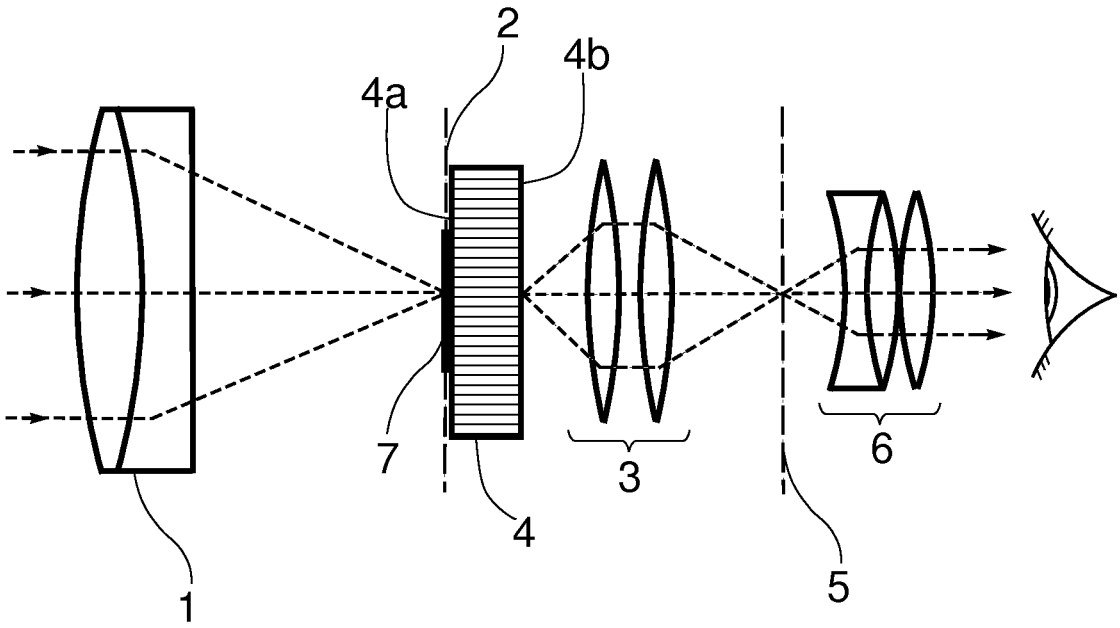
FIG. 5 is a side view depicting the arrangement of elements in a third embodiment of the invention.

FIG. 5 shows a side schematic view of a third embodiment of the invention. This embodiment is a variation of the second embodiment wherein the fiber optic faceplate is relocated to the objective's focal plane. This can provide certain advantages in terms of the optimal design of optical elements such as objective and eyepiece lenses used in the invention.

With reference to FIG. 5, the third embodiment of the invention has an objective 1 which is an image forming device. The objective 1 has a focal plane 2 and an optical axis (not shown). The optical axis of the objective forms the optical axis of the telescopic gun sight. A fiber optic faceplate (FOFP) 4 is positioned on the optical axis after the objective such that its incident surface 4*a* is coplanar with the objective focal plane 2. An image erecting means 3 is positioned on the optical axis after the FOFP 4. An eyepiece 6 is positioned on the optical axis after the image erecting means 3. The eyepiece 6 has a focal plane 5. A reticle 7 is placed at the objective focal plane 2 to designate the point of aim.

With reference to FIG. 5, the objective 1 forms a first image of a distant target at its focal plane 2. This first image is laterally reversed and upside-down. The fiber optic faceplate (FOFP) 4 is positioned such that its incident surface 4*a* is coplanar with the objective focal plane 2. Therefore, it transfers said first image of the target pixel by pixel to its emitting surface 4*b*, forming a second image of the target on the emitting surface 4*b*. An image of the reticle 7 will be superposed on said second image of the target as well. The image erecting means 3 takes the said second image of the target from the emitting surface 4*b* of the FOFP and produces a laterally correct and upright third image of the target at the eyepiece focal plane 5. The eyepiece 6 converts said third image of the target into a virtual fourth image. An image of the reticle 7 will be superposed on said third image of the target and also on said fourth image. The shooter places his eye behind the eyepiece as shown in FIG. 5 and sees said fourth image of the target with an image of the reticle 7 superposed.

D. Advantages

Based on the above descriptions of some embodiments of the invention, a number of advantages of one or more aspects over existing sights are readily apparent:

1. The relative position of the reticle on the target image seen by the shooter does not change if the shooter moves his eye behind the sight. In other words, the sight is free from parallax error at all target distances.
2. In at least one embodiment, the sight's full field of view can be seen even when the shooter's eye is not aligned with the sight's optical axis. In other words, the sight has a wide viewing angle.
3. In at least one embodiment, the sight's full field of view can be seen from any comfortable distance behind the sight. In other words, the sight provides a long and comfortable eye relief.

Additional advantages of one or more aspects are to remove the need for manual parallax calibration in the field, enabling fast target acquisition due to a wide and comfortable viewing angle and the possibility to retro-fit current rifle scopes with a thin fiber optic faceplate or other coherent image conduit devices (such as a ground glass projection screen) to make them parallax-free. These and other advantages of one or more aspects may now be apparent to the reader from a consideration of the foregoing description and accompanying drawings.

IX. CONCLUSION, RAMIFICATIONS, AND SCOPE

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention.

While the above descriptions of the present invention contain numerous specificities, they should not be construed as limiting the scope of the invention, but as mere illustrations of some of the preferred embodiments thereof. Many other ramifications and variations are possible within the expositions of the various embodiments. For example:

1. The objective 1 may comprise one or more lens elements arranged in one or more groups.
2. In the drawings, the image erecting means 3 is shown symbolically as a focal relay system comprising a pair of lenses. This is a preferred implementation since this arrangement can also function as a variable magnifier (zoom) device. However, this should not be construed as limiting or otherwise restricting the scope of the invention. Persons skilled in the art of optical engineering are familiar with other methods of implementing the image erecting means 3 including using afocal prismatic devices such as Porro prisms, Abbe prisms, Schmidt-Pechan prisms, etc. When an afocal image erecting means is used, the paths of light rays may be different than those shown in the accompanying drawings. Those skilled in the art would be familiar with adapting the illustrated embodiments of the invention to an afocal image erecting means.

3. The incident surface 4*a* and the emitting surface 4*b* of the fiber optic faceplate 4 need not be flat as depicted in the drawings. It may be desirable to impart a certain amount of curvature to these surfaces so that they match the image field curvature (also known as Petzval curvature) associated with the objective and the eyepiece/erecting means used in the invention.
4. The fiber optic faceplate 4 may be substituted with a fiber optic taper. A fiber optic taper is similar to a fiber optic faceplate but the diameter of its constituting fibers at the emitting and incident surfaces are different. A fiber optic taper magnifies or reduces an image while transferring it (depending on which end is used as input). Currently, fiber optic tapers are used for image magnification or minification in endoscopes, image intensifier systems, medical and dental radiography, fluoroscopy, and other advanced imaging applications. In the present invention, the fiber optic faceplate 4 may be substituted with a fiber optic taper in order to mitigate parallax error and provide image magnification at the same time.
5. The fiber optic faceplate 4 may be substituted with other coherent image conduit devices such as a micro lens array, a capillary array, a ground glass focusing screen, a rear-projection screen or any other equivalent apparatus or material that has the ability to transfer a real image from one surface to another in accordance with the invention.
6. In the drawings, the reticle 7 is shown positioned coplanar with the objective focal plane 2. It is possible to position the reticle in other locations in the optical path of a telescopic sight. Persons skilled in the art of optical engineering would be familiar with these other locations. For example, the reticle can be placed coplanar with the incident surface 4*a* or coplanar with the emitting surface 4*b* of the fiber optic faceplate. A reticle can also be directly printed or etched on the incident surface or the emitting surface of the fiber optic faceplate.
7. Means for adjusting the reticle 7 for elevation and windage compensation might be added to the embodiments shown in FIGS. 3 to 5. However, these means are not essential features of the present invention and are not shown. Persons skilled in the art would be familiar with adding suitable elevation and windage adjustment means to the telescopic sight described in the present invention.

Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art. Thus, the scope of the invention should be determined by the appended claims and their legal equivalents, as opposed to the embodiments illustrated.

What is claimed is:

1. A telescopic sight for designating a weapon's point of aim when pointed at a target, comprising:

a. an objective forming a single first image of the target, said objective consisting of one or more lens elements, said objective having a single focal plane, said objective forming said first image of the target at said focal plane, said first image being formed from visible light coming from the target, b. an image-erecting means for converting said first image of the target into an upright and laterally-correct second image of the target, said image-erecting means being made of lenses or prisms, said image-erecting means being positioned opposite said objective, c. a coherent image conduit having an incident surface and an emitting surface, said coherent image conduit being positioned opposite said image-erecting means, the incident surface of said coherent image conduit being positioned coplanar with said second image of the target so that said coherent image conduit forms a third image of the target on said emitting surface, said third image of the target being directly visible to an operator, and d. a reticle, said reticle being positioned coplanar with a plane selected from the group consisting of the objective focal plane, the incident surface of said coherent image conduit, and the emitting surface of said coherent image conduit, whereby an operator can view and use said third image of the target for the purpose of aiming.

2. The telescopic sight of claim 1 wherein said coherent image conduit is comprised of a fiber optic faceplate.

3. A telescopic sight for designating a weapon's point of aim when pointed at a target, comprising:

a. an objective forming a single first image of the target, said objective consisting of one or more lens elements, said objective having a single focal plane, said objective forming said first image of the target at said focal plane, said first image being formed from visible light coming from the target, b. an image-erecting means for converting said first image of the target into an upright and laterally-correct second image of the target, said image-erecting means being made of lenses or prisms, said image-erecting means being positioned opposite said objective, c. a coherent image conduit having an incident surface and an emitting surface, said coherent image conduit being positioned opposite said image-erecting means, the incident surface of said coherent image conduit being positioned coplanar with said second image of the target so that said coherent image conduit forms a third image of the target on said emitting surface, d. a reticle, said reticle being positioned coplanar with a plane selected from the group consisting of the objective focal plane, the incident surface of said coherent image conduit, and the emitting surface of said coherent image conduit, and e. an eyepiece, said eyepiece being positioned opposite said coherent image conduit so as to be able to convert said third image of the target into a virtual fourth image of the target whereby an operator can view and use said fourth image of the target for the purpose of aiming.

4. The telescopic sight of claim 3 wherein said coherent image conduit is comprised of a fiber optic faceplate.

5. A telescopic sight for designating a weapon's point of aim when pointed at a target, comprising:

a. an objective forming a single first image of the target, said objective consisting of one or more lens elements, said objective having a single focal plane, said objective forming said first image of the target at said focal plane, said first image being formed from visible light coming from the target, b. a coherent image conduit having an incident surface and an emitting surface, said coherent image conduit being positioned opposite said objective, the incident surface of said coherent image conduit being coplanar with said first image of the target so that said coherent image conduit forms a second image of the target on said emitting surface, c. a reticle, said reticle being mounted coplanar with a plane selected from the group consisting of the incident surface of said coherent image conduit and the emitting surface of said coherent image conduit, d. an image-erecting means for converting said second image of the target into an upright and laterally-correct third image of the target, said image-erecting means being made of lenses, said image-erecting means being positioned opposite said coherent image conduit, and e. an eyepiece, said eyepiece being positioned opposite said image-erecting means so as to be able to convert said third image of the target into a virtual fourth image of the target, whereby an operator can view and use said fourth image of the target for the purpose of aiming.

6. The telescopic sight of claim 5 wherein said coherent image conduit is comprised of a fiber optic faceplate.

* * * * *